United States Patent [19]

Iimori et al.

[11] 4,126,845

[45] Nov. 21, 1978

[54] TEMPERATURE RESPONSIVE CURRENT INTERRUPTER

[75] Inventors: Nobuyuki Iimori; Wasuke Koseki; Atsuo Ono, all of Kadoma, Japan

[73] Assignee: Matsushita Electric Industrial Co., Ltd., Japan

[21] Appl. No.: 787,203

[22] Filed: Apr. 13, 1977

[30] Foreign Application Priority Data

Apr. 15, 1976 [JP] Japan ..... 51-47443[U]

[51] Int. Cl.[2] ..... H01H 37/76

[52] U.S. Cl. ..... 337/408; 337/409

[58] Field of Search ..... 337/407, 408, 409

[56] References Cited

U.S. PATENT DOCUMENTS

| | | | |
|---|---|---|---|
| 2,934,628 | 4/1960 | Massar et al. | 337/409 |
| 2,955,179 | 10/1960 | Milton et al. | 337/403 |
| 3,155,800 | 11/1964 | Denton | 337/409 |
| 3,274,361 | 9/1966 | Ebensteiner et al. | 337/409 X |
| 3,281,559 | 10/1966 | Ebensteiner | 337/403 |
| 3,291,945 | 12/1966 | Merrill et al. | 337/407 X |
| 3,820,050 | 6/1974 | Tyler et al. | 337/408 |

*Primary Examiner*—George Harris

*Attorney, Agent, or Firm*—Robert E. Burns; Emmanuel J. Lobato; Bruce L. Adams

[57] ABSTRACT

A temperature responsive current interrupter in which two conductors are connected by electrically conductive, low-melting-point fusible elements respectively mounted on the conductors and a connector element interconnecting the fusible elements and urged against an electrically non-conductive high-melting-point fusible element, the connector element being moved into a position separate from at least one of the conductors when the high-melting-point fusible element is melted by heat.

29 Claims, 18 Drawing Figures

TEMPERATURE RESPONSIVE CURRENT INTERRUPTER

FIELD OF THE INVENTION

The present invention relates to electric current interrupters and, particularly, to temperature reponsive current interrupters or fuses for use in various kinds of electric circuits for interrupting currents in the circuits in the event the temperatures surrounding the interrupters happen to rise to unusually high levels.

BACKGROUND OF THE INVENTION

A variety of temperature responsive current interrupters have thus far been proposed and put into practical use for the protection of electric appliances from being overheated by ambient temperatures. Such devices are largely categorized as those of the types which use electrically conductive, low-melting-point metals or alloys as the temperature responsive fusible elements and those of the types which use electrically nonconductive, thermally fusible temperature responsive elements. A typical example of the known temperature responsive current interrupters using low-melting-point metals or alloys is the device in which two current conductors are normally connected by a fusible elements of a low-melting-point alloy and are urged to be disconnected from each other by suitable biasing means such as a weight or a preloaded spring. The mechanical and accordingly electrical connection between the two current conductors is broken by the action of such biasing means when the fusible element between the conductors is caused to melt by heat exceeding a predetermined temperature. A representative example of temperature responsive current interrupters or fuses of this nature is disclosed in U.S. Pat. No. 3,639,874 in which the biasing means acting on the current conductors are constituted by preloaded springs. Current interrupters thus using fusible elements of low-melting-point metals or alloys are advantageous in that the fusible elements interconnecting the current conductors are electrically conductive and are per se operable to provide electrical connection between the current conductors without aid of any extra members mechanically connecting the conductors. Such current interrupters are, however, not fully acceptable because of the difficulty in accurately controlling the melting points of the fusible elements of the individual interrupters so that the melting points of the fusible elements are liable to vary from one interrupter to another or from one lot of interrupters to another. Because, moreover, of the fact that the fusible elements used as the electric connectors are subjected to oxidizing effects due to the currents which flow therethrough during use of the current interrupters, the melting points of the fusible elements of low-melting-point metals or alloys are inevitably subject to change with time.

These problems encountered in temperature responsive current interrupters of the types using fusible temperature responsive elements of low-melting-point metals or alloys are alleviated or practically eliminated in current interrupters of the types which use electrically non-conductive, thermally fusible temperature responsive elements because the melting points of such elements can be easily and accurately controlled during production of the interrupters on a large-scale commercial basis and are maintained substantially unchanged throughout the use of the interrupters since the temperature responsive elements per se are not used as electric connectors for the current conductors of the interrupters and are therefore free from oxidizing effects. However, because, of the fact that the temperature responsive fusible elements of electrically non-conductive properties are not operable as means for electrically connecting conductors, extra elements are required for providing electrical connection between the conductors. Provision of such extra mechanical elements not only adds to the total number of the component parts and accordingly the production cost of a current interrupter but raises a problem in controlling the performance characteristics of the interrupter due to the sliding frictions produced between the mechanical elements or connectors which are moved from the positions providing electrical connection between the current conductors to positions interrupting such connection when the temperature responsive fusible elements are melted away by unusually high ambient temperatures, as will be discussed in more detail as the description proceeds. The present invention contemplates elimination of these drawbacks which have been inherent in prior-art temperature responsive current interrupters using electrically conductive or non-conductive, thermally fusible temperature responsive elements.

It is therefore, an important object of the present invention or provide an improved temperature responsive current interrupter or fuse featuring, inter alia, ease and accuracy in controlling the melting point of a temperature responsive fusible element forming part of the current interrupter during production of the device.

It is another important object of the present invention to provide an improved temperature responsive current interrupter or fuse in which the temperature responsive fusible element is free from oxidizing effect resulting from the flow of electric current through the current interrupter during use of the device and in which the melting point of the fusible element can be maintained substantially constant throughout the period of time for which the interrupter is in use.

It is still another important object of the present invention to provide an improved temperature responsive current interrupter which includes no such mechanical element as to be subjected to sliding friction when the current interrupter is caused to break the electrical connection between the current conductors of the device and which is capable of providing reliability in cutting off the flow of current therethrough in response to a rise in the temperature of the ambient heat to a predetermined threshold level.

It is still another important object of the present invention to provide an improved temperature responsive current interrupter which is simple in construction and which is accordingly easy and economical to manufacture on a large-scale commercial basis.

Yet, it is another important object of the present invention to provide an improved temperature responsive current interrupter in which both electrically conductive and non-conductive temperature responsive fusible elements are used in combination so that the advantages of prior-art temperature responsive current interrupters of both of the types using conductive and non-conductive fusible elements are exploited in simple configuration.

SUMMARY OF THE INVENTION

In accordance with the present invention, these and other objects are accomplished basically in a temperature responsive current interrupter which comprises a thermally conductive, hollow casing, two elongated conductors which extend into the casing through insulating means secured to the casing and which have respective inner axial end portions which are spaced apart from each other within the casing, two electrically conductive, normally rigid, thermally fusible elements each having a predetermined melting point and mounted on each of the inner axial end portions of the conductors, an electrically conductive connector element interconnecting the conductive fusible elements, an electrically non-conductive, normally rigid, thermally fusible element which has a predetermined melting point higher than the melting point of each of the conductive fusible elements and which is in surface-to-surface contact with the connector element, the connector element being movable toward a position separate from at least one of the conductors in the absence of the non-conductive fusible element in a rigid state, and resilient biasing means urging the connector element toward the above mentioned position thereof.

In accordance with a more detailed aspect of the present invention, there is provided a temperature responsive current interrupter which comprises in combination a thermally conductive, hollow, elongated casing having opposite longitudinal end portions, first and second insulating plugs each securely positioned at least in part in each of the longitudinal end portions of the casing, the insulating plugs having respective inner end faces which are spaced apart a predetermined distance from each other within the casing, an electrically non-conductive, normally rigid, thermally fusible element having a predetermined melting point and having opposite end faces one of which is in contact with the inner end face of the first insulating plug and the other of which is spaced apart a predetermined distance from the inner face of the second insulating plug, a first elongated conductor axially extending through the first insulating plug and the non-conductive fusible element into the casing and having an inner axial end portion axially projecting from the aforesaid other end face of the nonconductive fusible element, a second elongated conductor axially extending through the second insulating plug into the casing and having an inner axial end portion axially projecting from the inner end face of the second insulating plug, the respective inner axial end portion of the first and second conductors extending substantially in line with each other and axially spaced apart a predetermined distance from each other within the casing, two tubular, electrically conductive, normally rigid, thermally fusible elements each having a predetermined melting point which is lower than the melting point of the non-conductive fusible element and closely received on the inner axial end portion of each of the first and second conductors, an electrically conductive connector element having a tubular portion and a flange portion which radially outwardly projects from one axial end of the tubular portion and which has an outer end face held in contact with the aforesaid other end face of the nonconductive fusible element, the tubular portion of the connector element having axial end portions respectively having the conductive fusible elements closely received therein for providing electrical connection between the first and second conductors through the conductive fusible elements and the connector element, the connector element being movable away from the inner end face of the second insulating plug toward a position separate from the inner axial end portion of the second conductor in the absence of the non-conductive fusible element in a rigid state, and resilient biasing means urging the flange portion of the connector element against the opposite end face of the non-conductive fusible element to the first insulating plug and thereby biasing the connector element to move toward the aforesaid position of the connector element.

In accordance with another detailed aspect of the present invention, there is provided a temperature responsive current interrupter which comprises in combination a thermally conductive hollow casing having an end wall portion closing one end of the casing, an insulating plug closely received at least in part in a longitudinal end wall portion of the casing adjacent to the other end of the casing, an electrically non-conductive, normally rigid, thermally fusible element having a predetermined melting point and opposite end faces one of which is in close contact with the inner face of the end wall portion of the casing, an electrically conductive connector element having opposite end faces one of which is in contact with the other end face of the non-conductive fusible element and the other of which is spaced apart a predetermined distance from the inner end face of the insulating plug, the connector element being formed with two through holes having respective center axes substantially normal to the other end face of the non-conductive fusible element, two tubular, electrically conductive, normally rigid, thermally fusible elements each of which has a predetermined melting point lower than the melting point of the non-conductive fusible element and which is closely inserted in each of the through holes in the connector element, two elongated conductors extending through the insulating plug into the casing and having respective inner axial end portions axially projecting substantially in parallel with each other from the inner end of the insulating plug in directions substantially normal to the end faces of the connector element, the respective inner axial end portions of the conductors being closely received in the conductive fusible elements, respectively, for thereby being electrically connected together through the conductive fusible elements and the connector element, the connector element being movable away from the inner end of the insulating plug toward a position close to the end wall portion of the casing and separate from the respective inner axial end portions of the conductors in the absence of the non-conductive fusible element in a rigid state, and resilient biasing means urging the connector element against the end face of the conductive fusible element opposite to the end wall portion of the casing for thereby biasing the connector element toward the aforesaid position thereof.

The drawbacks of a prior-art temperature responsive current interrupter and the features and advantages of a temperature responsive current interrupter according to the present invention as basically constructed and arranged as hereinbefore described will be more clearly understood from the following description taken in conjunction with the accompanying drawings in which like reference numerals designate corresponding members, elements and entities.

DETAILED DESCRIPTION OF THE PRIOR ART

Figure 1:
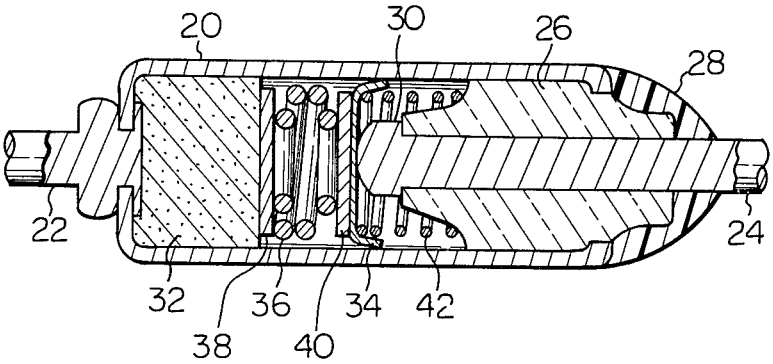
Fig. 1 PRIOR ART
FIG. 1 is a longitudinal sectional view showing an example of a prior-art temperature responsive current interrupter of the type to which the present invention appertains.

Referring first to FIG. 1 of the drawings, there is shown a representative example of a prior-art temperature responsive current interrupter of the type using an electrically nonconductive, temperature responsive fusible element. The current interrupter or electric switch herein shown is disclosed in U.S. Pat. No. 3,519,972 and comprises a tubular, electrically and thermally conductive casing 20 which has a first conductor 22 securely connected to one end wall of the casing 20 and a second conductor 24 axially extending into the casing 20 through the other end of the casing and electrically insulated from the casing 20 by means of an insulating plug 26 and an electrically non-conductive sealing compound 28, the second conductor 24 having an inner head portion 30 projecting outwardly from the insulating plug 26. An electrically nonconductive, normally rigid, thermally fusible pellet 32 is fixedly positioned within the casing 20 at a suitable spacing from the head portion 30 of the second conductor 24. Between the pellet 32 and the head portion 30 of the second conductor 24 is located an electrically conductive member 34 having a peripheral edge portion which is resiliently in slidable contact with the inner peripheral surface of the casing 20. The conductive member 34 is urged to contact the head portion 30 of the second conductor 24 by means of a preloaded first compression spring 36 which is seated at one end on a first springload distributing disc 38 pressed against the inner face of the pellet 32 and at the other end on a second springload distributing disc 40 which is pressed against one face of the conductive member 34. A second compression spring 42 is seated at one end on the other face of the conductive member 34 and at the other end on the insulating plug 26 and urges the conductive member 34 axially away from the head portion 30 of the second conductor 24 against the opposing force of the first compression spring 36. When the fusible pellet 32 remains rigid with the first spring-load distributing disc 38 pressed onto the inner face thereof, the first compression spring 36 is kept compressed and overcomes the force of the second compression spring 42 so that the conductive member 34 is held in contact with the head portion 30 of the second conductor 24. Electrical connection is thus established between the first and second conductors 22 and 24 through the casing 20 and the conductive member 34 which is held in contact with the head portion 30 of the second conductor 24. In the event the temperature around the casing 20 rises to a predetermined level heating the fusible pellet 32 to the melting point thereof, the pellet 32 is caused to melt and thus becomes fluidic so that the first spring-load distributing disc 38 is axially moved away from the second spring-load distributing disc 40 by the force of the compression spring 36 which is allowed to expand from the compressed condition thereof. The second compression spring 42 now overcomes the force of the opposing force of the first compression spring 38 and forces the conductive member 34 to move away from the head portion 30 of the second conductor 24, thus interrupting the electrical connection between the conductive member 34 and the head portion 30 of the second conductor 24 and accordingly between the first and second conductors 22 and 24.

While various other advantages may be achieved in the construction and arrangement of a temperature responsive current interrupter of the above described nature, the foremost advantage of such a current interrupter is the ease and accuracy in controlling the threshold temperature at which the conductive member 34 is initiated into motion to move away from the head portion 30 of the second conductor upon collapse of the fusible pellet 32. This advantage is ascribable to the fact that the pellet 32 is non-conductive and is thus not contributive to the formation of the electrical connection between the conductors 22 and 24 and that the compression springs 36 and 42 are arranged to exert their forces on the conductive member 34 in directions which are coincident with the direction in which the conductive member 24 is to be moved within the casing 20. Such an advantage is, however, offset by a drawback that, because of the very fact that the fusible pellet 32 per se can not be used as means to provide electrical connection between the casing 20 and the second conductor 24, extra elements such as the conductive member 34 and the spring-load distributing discs 38 and 40 are required for maintaining such electrical connection. Even though, furthermore, the threshold temperature at which the fusible pellet 26 is to start to melt can be controlled accurately by the manufacturer of the device, the sliding friction produced between the conductive member 34 and the casing 20 when the conductive member 34 is initiated into sliding motion on the casing 20 tends to create unforeseen irregularity in the movement of the conductive member 34 and thus makes it difficult to precisely control the timing at which the conductive member 34 is to be disengaged from the head portion 30 of the second conductor 24 upon collapse of the pellet 32. The casing 20 per se forming part of the electrical connection between the first and second conductors, the casing 20 must be mounted on a support member or structure by means of an electrically and thermally non-conductive material or materials if the support member or structure is electrically and thermally conductive. Provision of such an electrical and thermal insulator contacting the casing 20 tends to impair the responsiveness of the casing to temperature and may upset the designed performance characteristics of the current interrupter depending upon the specific nature of the insulating material used. It may also be pointed out that the mechanical connections between the casing 20 and the conductive member 34 and between the conductive member 34 and the head portion 30 of the second conductor 24 tend to produce therebetween contact resistances which result in generation of heat in the current interrupter when the interrupter is in use with a current flowing therethrough. This may also impair the designed performance characteristics of the current interrupter depending upon the intensity of the current which is to be normally in use. The present invention contemplates elimination of these drawbacks of the described type of prior-art temperature responsive current interrupters by having recourse to the use of a combination of electrically conductive and non-conductive, thermally fusible temperature responsive elements in a resistance responsive current interrupter, preferred embodiment of such a current interrupter being shown in FIGS. 2 to 18 of the accompanying drawings.

Figure 2:
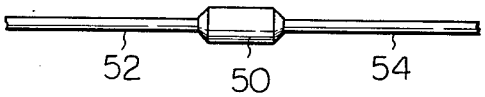
FIG. 2 is a side elevational view showing the external apperance of a temperature responsive current interrupter embodying the present invention.
Figure 3:
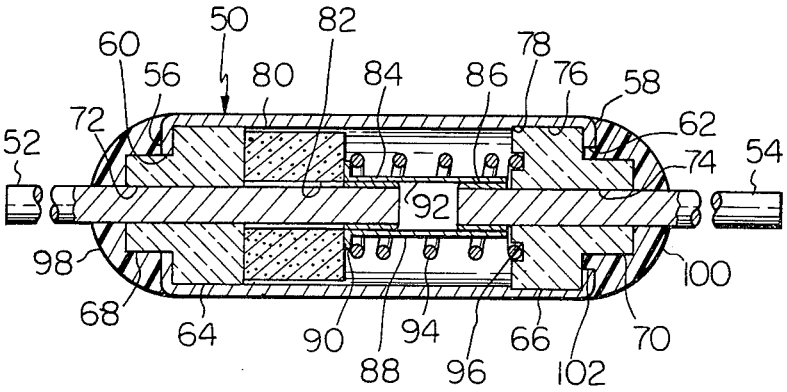
FIG. 3 is a longitudinal sectional view showing a first preferred embodiment of the current interrupter according to the present invention.
Figure 4:
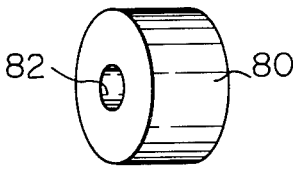
FIG. 4 is a perspective view showing the configuration of a non-conductive fusible element incorporated into the embodiment of FIG. 3.

Referring to FIGS. 2 and 3 of the drawings, a first preferred embodiment of a temperature responsive current interrupter according to the present invention is shown comprising a thermally conductive, hollow cylindrical casing 50 having a center axis therethrough and first and second conductors 52 and 54 extending in opposite directions from the axial ends of the casing 50 as will be better seen in FIG. 2, each of the conductors 52 and 54 being in elongated wire or rod form. As seen in FIG. 3, the casing 50 has at the opposite axial ends thereof first and second annular end wall or inner flange portions 56 and 58 which have respective inner peripheral edges forming circular openings 60 and 62, respectively, having center axes which are substantially in line with the center axis of the casing 50 as a whole. While the casing 50 may be constructed of any rigid material which is electrically conductive or non-conductive and thermally conductive, the same is herein assumed by way of example to be formed of a rigid metal which is electrically conductive. The casing 50 has first and second insulating plugs 64 and 66 closely and fixedly received each in part on the respective inner peripheral surfaces of its opposite cylindrical end wall portions adjacent to the first and second inner flange portions 56 and 58 of the casing 50. The first insulating plug 64 has an axial projection 68 which protrudes axially outwardly from the first inner flange portion 56 through the opening 60 in the flange portion 56. The projection 68 of the first insulating plug 64 is assumed to be substantially equal in diameter to the opening 60 in the flange portion 56 so that the inner peripheral edge of the flange portion 56 is in close contact with the projection 68 of the plug 64. The second insulating plug 66 also has an axial projection 70 protruding outwardly from the second inner flange portion 58 of the casing 50 through the opening 62 in the flange portion 58. The projection 66 of the second insulating plug 70 is assumed to be smaller in diameter than the opening 62 in the flange portion 58 so that an annular gap is formed between the projection 70 and the inner peripheral edge of the flange portion 58 as shown. The insulating plugs 64 and 66 are formed with axial bores 72 and 74, respectively, each of which is open at both axial ends of each plug and has a center axis substantially aligned with the center axis of the casing 50. The first and second conductors 52 and 54 extend through these bores 72 and 74 in the first and second insulating plugs 64 and 66, respectively, into the casing 50 and have their respective inner ends axially spaced apart a predetermined distance from each other, the second conductor 54 axially projecting over a predetermined length from the inner axial end of the associated insulating plug 66. The conductors 52 and 54 are firmly passed through the insulating plugs 64 and 66 respectively, and thus have respective center axes which are substantially in line with each other. The casing 50 is shown to have internally formed in its cylindrical end wall portion adjacent to the second inner flange portion 58 of the casing 50 a circumferential groove 76 which has one axial end located next to the inner face of the flange portion 58, the other axial end of the circumferential groove being axially spaced apart a predetermined distance from the inner face of the flange portion 58 and forming an internal annular face 78 through which the inner peripheral surface of the remaining cylindrical wall portion of the casing 50 is radially outwardly stepped into the circumferential groove 76 as will be seen from FIG. 3. The second insulating plug 66 is snugly and fixedly received in the circumferential groove 76 thus formed in the casing 50 and has its inner end face in close contact with the internal annular face 78 of the casing 50. Thus, the circumferential groove 76 forming the internal annular face 78 is adapted to have the plug 66 axially positioned accurately relative to the casing 50 when the plug 66 is to be assembled to the casing 50. If, desired, the casing 50 may be further formed with a similar circumferential groove in its cylindrical end wall portion adjacent to the first inner flange portion 56 of the casing 50 for enabling the first insulating plug 64 to be axially positioned accurately with respect to the casing 50, though not shown in the drawings.

The current interrupter embodying the present invention further comprises a cylindrical temperature responsive fusible element 80 constructed of an electrically non-conductive, normally rigid, thermally fusible pellet of a compound preferably selected from the group consisting of acetanilide, succinimide, inositol (cyclohexanehexol), coumalin(benzo-α-pyrone) and vanilin (4-hydroxy-3-methoxybenzaldehyde). The temperature responsive fusible element 80 is positioned within the casing 50 with one of the axial end faces held in close contact with the inner axial end face of the first insulating plug 64. As is better seen in FIG. 4, the temperature responsive fusible element 80 is formed with an axial bore 82 which is open at both axial ends of the element 80. The axial bore 82 thus formed in the temperature responsive fusible element 80 is slightly larger in diameter than the first conductor 52 as will be seen from FIG. 3 and has passed therthrough the second conductor 52 in such a manner that the conductor 52 axially projects from the fusible element 80 over a predetermined length from the other end face of the element 80.

The first conductor 52 has a tubular terminal element 84 which is securely received on its inner axial end portion projecting from the temperature responsive fusible element 80 and, likewise, the second conductor 54 has a tubular terminal element 86 which is securely received on its inner axial end portion projecting from the second insulating plug 66, the terminal elements 84 and 86 having substantially equal outside diameters. Each of the terminal elements 84 and 86 thus mounted on the first and second conductors 52 and 54, respectively, is formed of an electrically conductive, normally rigid, thermally fusible alloy having a predetermined melting point lower than the melting point of the material constructing the temperature responsive fusible element 80, such an alloy being preferably selected from the group consisting of alloys containing bismuth, cadmium, lead and/or tin in desired proportions. Thus, the temperature responsive fusible element 80 and each of the terminal elements 84 and 86 will be hereinafter referred to as high-melting-point and low-melting-point fusible elements, respectively.

Figure 5:
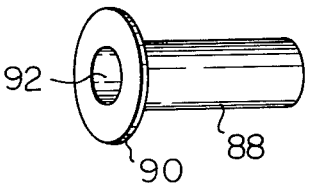
FIG. 5 is a perspective view of the configuration of an electrical connector element also forming part of the embodiment of FIG. 3.

The current interrupter embodying the present invention further comprises a flanged tubula connector element 88 which has an annular flange portion 90 radially outwardly projecting from one axial end of the tubular wall portion of the connector element 86 as will be better seen in FIG. 5. The tubular connector element 88 has an axial bore 92 which is open at both axial ends of the connector element 88 and which is substantially equal in diameter to each of the low-melting-point fusible elements 84 and 86. As illustrated in FIG. 3, the connector element 88 is positioned within the casing 50 with the low-melting-point fusible elements 84 and 86 on the projecting inner axial end portions of the conductors 52 and 54 closely received in opposite axial portions thereof and with its annular flange portion 90 received on the inner axial end face of the high-melting-point fusible element 80. The connector element 88 is constructed of an electrically conductive rigid metal and thus provides electrical connection between the first and second conductors 52 and 54 through the low-melting-point fusible elements 84 and 86. A preloaded helical compression spring 94 is positioned around the tubular wall portion of the connector element 88 and is seated at one end on the inner face of the flange portion 90 of the connector element 88 and at the other end on the inner end face of the second insulating plug 66, thereby urging the connector element 88 axially away from the second insulating plug 66 and thus forcing the annular flange portion 90 of the connector element 88 against the inner end face of the high-melting-point fusible element 80. By preferance, the second insulating plug 66 may have formed in its inner axial end wall an annular groove 96 which is in concentrically surrounding relationship to a portion of the second conductor 54 and in which the compression spring 94 is received at the outer axial end thereof. The high-melting-point fusible element 80 is thus urged axially away from the second insulating plug 66 and is accordingly pressed against the inner end face of the first insulating plug 64. As a consequence, the first and second insulating plugs 64 and 66 are urged axially away from each other and forced against the inner faces of the first and second inner flange portions 56 and 58, respectively, of the casing 50. The compression spring 94 and accordingly the annular groove 96 in the insulating plug 66 have inside diameters which are larger than the outside diameter of the tubular wall portion of the connector element 88 and smaller than the inside diameter of the cylindrical wall portion of the casing 50 so that the compression spring 94 is radially outwardly spaced apart throughout its length from the outer peripheral surface of the tubular wall portion of the connector element 88 and radially inwardly spaced apart throughout its length from the inner peripheral surface of the cylindrical wall portion of the casing 50 as shown in FIG. 3.

The axial projections 68 and 70 of the first and second insulating plugs 64 and 66 are embedded in the first and second sealing and insulating caps 98 and 100, respectively, which cover the respective outer faces of the first and second inner flange portions 56 and 58, respectively. The first and second conductors 52 and 54 projecting outwardly from the respective axial projections 68 and 70, respectively, of the first and second sealing plugs 64 and 66 are securely passed through these sealing and insulating caps 98 and 100, respectively. The sealing and insulating cap 100 on the axial projection 70 of the second insulating plug 66 has an annular projection or bead 102 closely fitting into the previously mentioned annular gap formed between the inner peripheral edge of the second inner flange portion 58 of the casing 50 and the axial projection 70 of the associated second insulating plug 66, as shown.

When, in the temperature responsive current interrupter device thus constructed and arranged, the temperature of the high-melting point fusible element 80 is lower than the melting point of the substance constructing the fusible element 80, the fusible element 80 is maintained in a rigid state and, thus, bears the axial force which is axially exerted thereon by the compression spring 94 through the annular flange portion 90 of the connector element 88. The connector element 88 is therefore allowed to stay in the axial position having its opposite axial end portions closely received on the respective outer peripheral surfaces of the low-melting-point fusible elements 84 and 86 on the first and second conductor elements 52 and 54, establishing electrical connection between the conductors 52 and 54 through the low-melting-point fusible elements 84 and 86 and the connector element 88.

Figure 6:
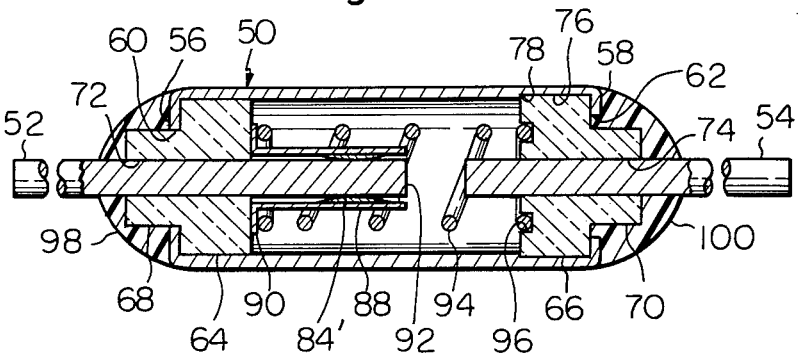
FIG. 6 is a view similar to FIG. 3 but shows the current interrupter in a condition interrupting the flow of current therethrough.

In the event the ambient temperature of the current interrupter happens to rise to an unusually high level and as a consequence each of the low-melting-point fusible elements 84 and 86 is heated to the melting point thereof, the fusible elements 84 and 86 are caused to melt and allow the connector element 88 to freely move relative to the conductors 52 and 54. When the temperature in the low-melting-point fusible element 80 thereafter reaches the melting point of the element the fusible element 80 is also caused to melt and is rapidly made fluidic. The molten material is therefore caused to flow past the annular flange portion 90 of the connector element 88 under the influence of the pressure exerted thereon from the flange portion 90 and allows the connector element 88 to be axially moved away from the second insulating plug 66 by the biasing force of the compression spring 94. The compression spring 94 which has been held in a compressed condition is now allowed to axially expand and forces the connector element 88 to axially move toward the first insulating plug 64 until the annular flange portion 90 of the connector element 88 is brought into contact with the inner end face of the first insulating plug 64 as shown in FIG. 6. When the connector element 88 is moved to the axial position having the flange portion 90 thus in contact with the inner end face of the first insulating plug 64, the connector element 88 is mechanically disengaged and accordingly electrically disconnected from the second conductor 54 and interrupts the electrical connection between the first and second conductors 52 and 54. Under these conditions, the molten material resulting from the low-melting-point fusible element 84 initially mounted on the inner axial end portion of the first conductor 52 is deposited as at 82' between the conductor 52 and the connector element 88.

Figure 7:
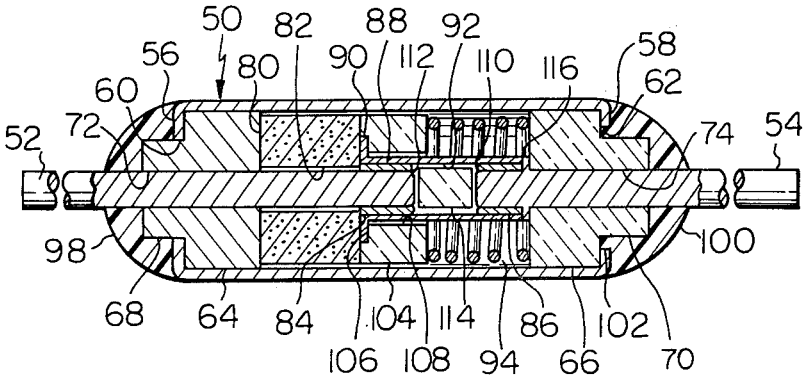
FIG. 7 is a longitudinal sectional view showing a second preferred embodiment of the current interrupter according to the present invention.
Figure 8:
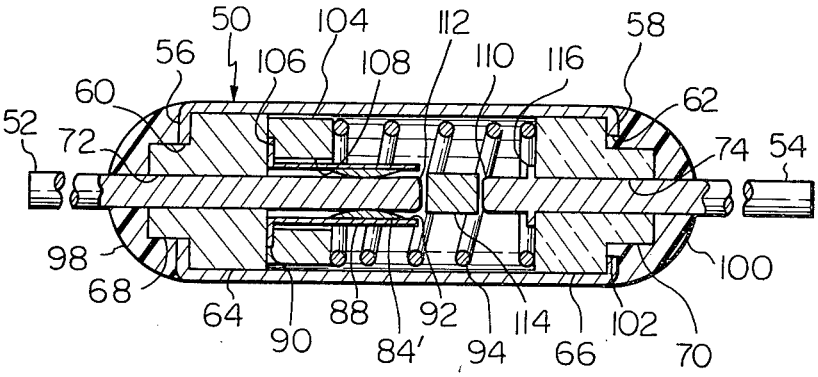
FIG. 8 is a view similar to FIG. 7 but shows the current interrupter in a condition interrupting the flow of current therethrough.

FIG. 7 illustrates a modification of the embodiment which has been hereinbefore described with reference to FIGS. 2 to 6. The embodiment herein shown comprises, in addition to the component elements of the device shown in FIG. 3, a generally cylindrical spring-seat member 104 constructed of a rigid, electrically non-conductive material. The spring-seat member 104 has a center axis therethrough and has formed a circular recess 106 in one axial end wall portion thereof and an axial bore 108 which is open at the bottom of the recess 106 and at the outer axial end of the member 104 and which has a center axis substantially coincident with the center axis of the member 104, the circular recess 106 being slightly larger in diameter than the outer peripheral edge of the flange portion 90 of the connector element 88 and the axial bore 108 being slightly larger in diameter than the tubular wall portion of the connector element 88. The spring-seat member 104 in its entirety has an outside diameter slightly smaller than the inside diameter of the cylindrical wall portion of the casing 50 and is positioned within the casing 50 with the tubular wall portion of the connector element 88 axially passed in part through the axial bore 108 and with the annular flange portion 90 of the connector element 88 received in the circular recess 106, as illustrated. The center axis of the spring-seat member 104 and accordingly the center axis of the axial bore 108 in the member 104 are thus substantially in line with the center axis of the first and second conductors 52 and 54 supporting the connector element 88 through the low-melting point fusible elements 84 and 86. The compression spring 94 is seated in an axially compressed condition between the inner end face of the second insulating plug 66 and the opposite axial end face of the spring-seat member 104 to the circular recess 106 so that the annular land portion surrounding the circular recess 106 in the member 104 is forced against the inner end face of the high-melting-point fusible element 80 with the flange portion 90 of the connector element 88 closely interposed between the high-melting-point fusible element 80 and the spring-seat member 104. The compression spring 94 constructed of metal is thus mechanically isolated and accordingly electrically insulated from the connector element 88 by the spring-seat member 104 which is electrically non-conductive. When the high-melting-point fusible element 80 is caused to melt by the heat surrounding the thermally conductive casing 50 as previously discussed in connection with the embodiment of FIG. 3, the connector element 88 and the spring-seat member 104 are axially moved as a single unit away from the second insulating plug 66 until they are brought into contact with the inner face of the first insulating plug 64 as illustrated in FIG. 8 by the force of the compression spring 94 which is axially expanded from the compressed condition and thus moves the connector element 88 by means of the spring-seat member 104. While, thus, the minimum insulation distance achieved in the first embodiment of FIG. 3 after the electrical connection between the first and second conductors 52 and 54 has been interrupted is provided by the radial spacing (which is assumed to be smaller than the distance between the respective inner ends of the conductors 52 and 54) between the projecting inner axial end portion of the second conductor 54 and the surrounding axial end portion of the expanded compression spring 94 as will be seen in FIG. 6, the minimum insulation distance achieved in the embodiment of FIG. 7 after the connector element 88 and the spring-seat member 104 have been moved into contact with the first insulating plug 64 as shown in FIG. 8 is provided by the axial spacing between the first and second conductors 52 and 54 or between the second conductor 54 and the connector element 88. The minimum insulation distance achievable in the embodiment of FIG. 7 being thus longer than the minimum insulation distance in the embodiment of FIG. 3, the casing 50 of the embodiment of FIG. 7 can be sized to be smaller in diameter than the casing 50 of the embodiment of FIG. 3 and the device shown in FIG. 7 is adapted to reduce the overall dimensions of a current interrupter having a basic construction shown in FIG. 3.

When in cutting into pieces a continuous metal wire drawn from a rod during fabrication of conductors, the cut segments of the wire are inevitably formed with burrs at the edges of their ends. Each of the conductors 52 and 54 in the embodiment of FIG. 3 is thus liable to have burrs remaining at the edge of its inner axial end. When the low-melting-point fusible element 86 on the second conductor 54 is fused by heat and thereafter the connector element 88 is axially moved away from the inner axial end of the second conductor 54 upon melting of the high-melting-point fusible element 80, the molten material which has been present between the inner axial end portion of the second conductor 54 and the inner peripheral surface of the connector element 88 attempts to stick to and trail on the burrs at the inner axial end of the conductor 54 as the connector element 88 is axially moved along the inner axial end portion of the conductor 54. When the connector element 88 is disengaged from the conductor 54, such a molten material tends to string between the inner axial end of the conductor 54 and the rearmost end of the connector element 88 being moved along the end portion of the conductor 54. The connector element 88 and the conductor 54 are thus bridged by the string of the molten alloy and as a consequence the electrical connection between the second conductor 54 and the connector element 88 and accordingly between the first and second conductor elements 52 and 54 fails to be interrupted until the string of the molten material is cut off. To avoid such an inconvenience, the second conductor 54 in the embodiment of FIG. 7 has the edge at its inner axial end chamfered or rounded as at 110 so as to remove the burrs from the end of the conductor 54 and to thereby eliminate the cause of the threading of the molten material between the conductor 54 and the connector element 88. If desired, the first conductor 52 may also be chamfered or rounded along the edge at its inner axial end as indicated at 112 for deburring purposes.

The stringing of the molten material between the second conductor 54 and the connector element 88 can also be avoided by provision of an insulating element 114 between the respective inner axial ends of the first and second conductors 52 and 54. The insulating element 114 is slightly larger in diameter than each of the first and second conductors 52 and 54 and slightly smaller in diameter than the inner peripheral surface of the tubular wall portion of the connector element 88 so that the molten material initially sticking to the inner peripheral surface of the connector element 88 is scrapped off by the insulating element 114 and is accordingly prevented from forming a string between the connector 54 and the connector element 88. The insulating element 114 may be bonded to the end face of at least one of the conductors 52 and 54 by a suitable adhesive or as an alternative may be supported under pressure between the end faces of the conductors.

The second conductor 54 in the embodiment of FIG. 7 is shown formed with a radial projection 116 in contact with the inner end face of the second insulating plug 66. The radial projection 116 thus formed on the second conductor 54 is adapted to enable the second conductor 54 to axially project accurately over a predetermined length from the inner end face of the insulating plug 66 when the subassembly of the conductor 54 and the insulating plug 66 is fitted to the casing 50 during assemblage of the protective device. The circumferential groove 76 formed in the casing 50 of the embodiment of FIG. 3 is thus dispensable in the embodiment shown in FIG. 7 because the axial position of the second conductor 54 relative to the casing 50 can be accurately dictated by means of the radial projection 116 of the conductor 54 without having recourse to the formation of the circumferential groove 76 in the casing 50.

Figure 9:
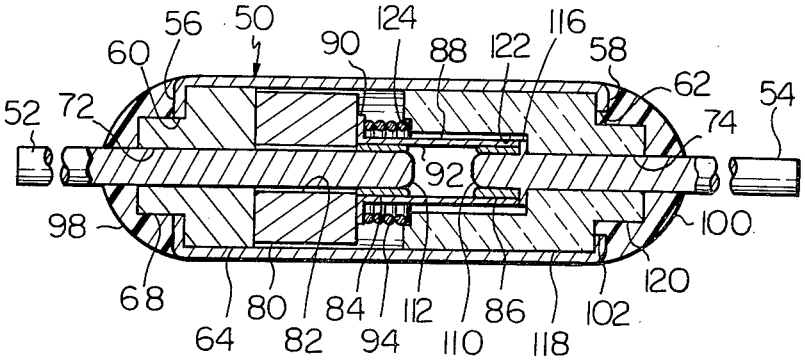
FIG. 9 is a longitudinal sectional view showing a third preferred embodiment of the current interrupter according to the present invention.

FIG. 9 illustrates a third preferred embodiment of the temperature responsive current interrupter according to the present invention. The embodiment shown in FIG. 9 is another modification of the embodiment illustrated in FIG. 3 and is adapted to increase the insulation distance in the current-interrupting condition of the device by modifying the configuration of the second insulating plug 66 of the embodiment shown in FIG. 3. The embodiment of FIG. 9 is thus characterized by a second insulating plug 118 which is securely positioned within the casing 50 axially at a predetermined spacing from the inner end face of the high-melting-point fusible element 80 and which is in part closely received on the inner peripheral surface of a cylindrical longitudinal wall portion of the casing 50. Similarly to the insulating plug 66 in the embodiment illustrated in FIG. 3, the insulating plug 118 has an axial projection 120 which protrudes axially outwardly from the second inner flange portion 58 of the casing 50 through the opening 62 in the flange portion 58 with an annular gap formed between the projection 120 and the inner peripheral edge of the inner flange portion 58 and which is embedded in the sealing and insulating cap 100 covering the outer face of the inner flange portion 58 of the casing 50. The second insulating plug 118 of the embodimend of FIG. 9 is further formed with an elongated axial concavity 122 having a center axis substantially in line with the center axis of the casing 50 and accordingly with the aligned center axes of the first and second conductors 52 and 54, the concavity 122 being open at the inner axial end of the plug 118. The second conductor 54 axially passed through the insulating plug 118 is shown formed with a radial projection 116 similarly to the second conductor 50 in the embodiment of FIG. 7 and has the radial projection 116 closely received on the bottom face of the concavity 122, having an inner axial end portion axially projecting over a predetermined length into the concavity 122 from the bottom face of the concavity. The axial concavity 122 thus formed in the insulating plug 118 has a diameter slightly larger than the outside diameter of the tubular wall portion of the connector element 88 having its annular flange portion 90 closely received on the inner end face of the high-melting-point fusible element 80. The tubular wall portion of the connector element 88 which is mounted on the respective inner axial end portions of the first and second conductors 52 and 54 with the low-melting-point fusible elements 84 and 86 interposed between the tubular wall portion of the connector element 88 and the inner axial end portions of the conductors 52 and 54 axially extends in part into the axial concavity 122 in the insulating plug 118 and has its axial end opposite to the annular flange portion 90 held in bearing contact with the radial projection 116 of the second conductor 54. The insulating plug 118 has further formed in its innermost axial wall portion an annular recess 124 having an inner circumferential end at the open axial end of the concavity 122. The compression spring 94 in a compressed condition is seated at one end on the inner end face of the high-melting-point fusible element 80 and at the other end in the annular recess 124 thus formed in the insulating plug 118.

Figure 10:
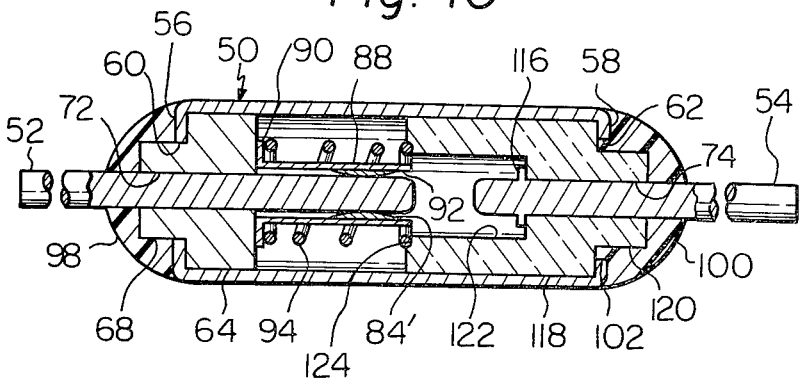
FIG. 10 is a view similar to FIG. 9 but shows the current interrupter in a condition interrupting the flow of current therethrough.

When the high-melting-point fusible element 80 is melted by the heat surrounding the casing 50 and as a consequence the connector element 88 is moved into the axial position having its flange portion 90 in pressing contact with the inner end face of the first insulating plug 64 by the force of the compression spring 94 which is now allowed to expand from the compressed condition as illustrated in FIG. 10, the connector element 88 is axially spaced apart from the inner axial end portion of the second conductor 54 and thus interrupts the electrical connection between the first and second conductors 52 and 54, as in the arrangement illustrated in FIG. 6. While the inner axial end portion of the second conductor 54 in the embodiment of FIG. 3 is merely radially spaced apart from the surrounding portion of the compression spring 94, the inner axial end portion of the second conductor 54 in the arrangement illustrated in FIG. 10 is not only radially but also axially spaced apart and accordingly electrically isolated from the spring 94 through a portion of the axial concavity 122 in the insulating plug 118 and, for this reason, the insulation distance between the second conductor 54 and the spring 94 which is in electrically conductive contact with the connector element 88 in the arrangement of FIG. 10 is far longer than the insulation distance between the second conductor 54 and the spring 94 in the arrangement of FIG. 6. It is, thus, important in the embodiment of FIG. 9 that the axial concavity 122 in the insulating plug 118 be so sized as to have its open end located at the longest possible distance from the inner axial end of the second conductor 54 which axially terminates within the concavity. The first and second conductors 52 and 54 in the embodiment of FIG. 9 are shown to have the edges of their respective inner axial ends chamfered or rounded as at 112 and 110 as in the embodiment of FIG. 7. If desired, an insulating element (not shown) similar to the insulating element 114 provided in the embodiment of FIG. 7 may be positioned between the respective inner axial end portions of the first and second conductors 52 and 54 for the reason previously described with reference to FIGS. 7 and 8.

Figure 11:
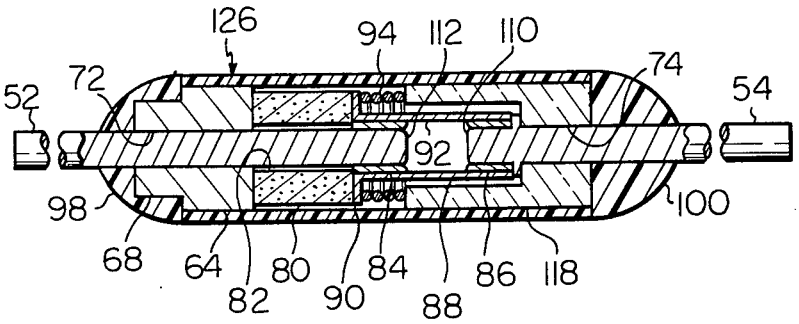
FIG. 11 is a longitudinal sectional view showing a fourth preferred embodiment of the current interrupter according to the present invention.
Figure 12:
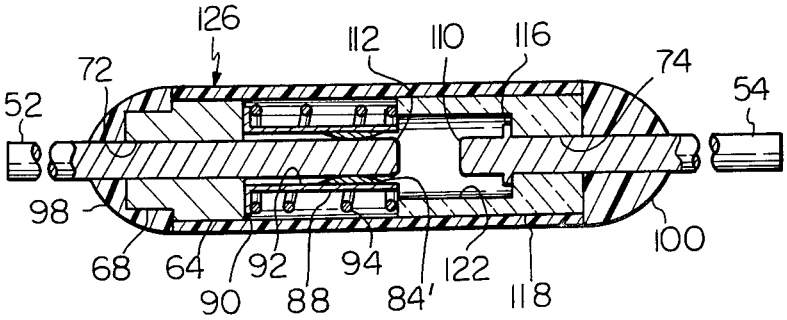
FIG. 12 is a view similar to FIG. 11 but shows the current interrupter in a condition interrupting the flow of current therethrough.

While the casing 50 in each of the embodiments of the present invention as hereinbefore described has been assumed to be formed of an electrically conductive material, the same may be constructed of an electrically non-conductive rigid material such as plastics, an example of such an embodiment being illustrated in FIGS. 11 and 12.

Referring to FIGS. 11 and 12, a temperature responsive current interrupter embodying the present invention is shown constructed essentially similarly to the above described embodiment of FIG. 9 except for a casing 126 which is formed of an electrically non-conductive, thermally conductive rigid material and which is void of inner flange poritions at the axial ends thereof. The casing 126 being thus constructed of an electrically non-conductive material, the compression spring 94 seated between the annular flange portion 90 of the connector element 88 and the inner end face of the second insulating plug 118 (which is shown void of an annular recess in its inner axial wall portion) can be positioned in close proximity to or even in contact with the inner peripheral surface of the casing 126 as shown. Such positioning of the spring 94 within the casing 126 permits of reduction of the diameter of the casing 126 and accordingly the overall dimensions of the current interrupter as a whole and is thus conducive to responsiveness of the interrupter to temperature. Because, furthermore, the casing 126 of the electrically non-conductive material can be integrally formed with one of the first and second insulating plugs 64 and 118 if desired, the number of the component parts of the device and accordingly the number of the steps to assemble the component parts together can be decreased so that not only the overall size but the production cost of the interrupter can be reduced.

Figure 13:
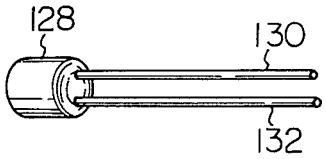
FIG. 13 is a perspective view showing the external appearance of another temperature responsive current interrupter embodying the present invention.
Figure 14:
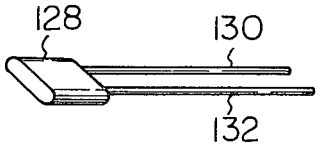
FIG. 14 is a view essentially similar to FIG. 13 but shows the external appearance of a modification of the current interrupter illustrated in FIG. 13.

While the present invention has been described to be embodied in an arrangement in which the current conductors extend in line with each other, the conductors may be arranged in parallel with each other as illustrated in FIGS. 13 and 14 in each of which a temperature responsive current interrupter embodying the present invention is shown largely comprising a casing 128 and first and second elongated conductors 130 and 132 each in rod or wire form.

Figure 15:
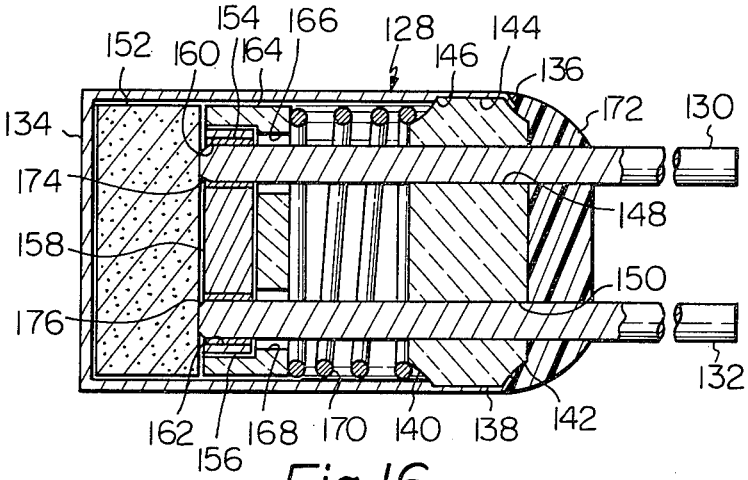
FIG. 15 is a longitudinal sectional view showing a fifth preferred embodiment of the current interrupter according to the present invention.

Referring to FIG. 15, the casing 128 forming part of the current interrupter generally configured as illustrated in FIG. 13 or 14 is open at one axial end and has an end wall portion 134 opposite to the open axial end and a radially or otherwise laterally inwardly bent edge 136 circumscribing the opening at the open axial end. The casing 128 in its entirety may have any configuration such as, for example, a generally cylindrical configuration as illustrated in FIG. 13 or a flattened configuration having an oval or generally rectangular cross section as shown in FIG. 14. The casing 128 may be formed of a rigid material which is electrically either conductive or non-conductive but is herein assumed by way of example to be constructed of an electrically conductive metal.

The open axial end of the casing 128 is firmly closed by an insulating plug 138 axially protruding in part from the end of the casing 128 and having the edges at the inner and outer axial edges chamfered or bevelled as at 140 and 142, the outer chamfered edge 142 being partially in close contact with the inner face of the inwardly bent edge 136 of the casing 128 so that the insulating plug 138 is closely retained to to the casing 128. The casing 128 may have internally formed in its axial wall portion adjacent to the bent edge 136 a circumferential groove 144 having the insulating plug 138 closely received therein. The circumferential groove 144 forms an internal edge 146 through which the inner peripheral surface of the casing 128 is radially or otherwise laterally inwardly stepped into the groove 144 and with which the inner chamfered edge 140 of the insulating plug 138 is partially in close contact. The insulating plug 138 is thus securely held in axial position relative to the casing 128 by close engagement between the inner chamfered edge 140 of the insulating plug 138 and the internal edge 146 of the casing 128 and between the outer chamfered edge 142 of the plug 138 and the inwardly bent edge 136 of the casing 128. The insulating plug 138 is formed with two axial bores 148 and 150 which are substantially parallel with the longitudinal wall portion of the casing 128 and which are open at both axial ends of the insulating plug 138. The above mentioned conductors 130 and 132 are closely passed through these parallel bores 148 and 150, respectively, and extend into the casing 128, terminating at substantially equal predetermined distances from the inner face of the end wall portion 134 of the casing 128 as shown.

A temperature responsive or high-melting-point fusible element 152 constructed of a pellet of an electrically non-conductive, normally rigid, thermally fusible material having a predetermined melting point is positioned within the casing 128 and has an outer peripheral surface received on the inner peripheral surface of the longitudinal wall portion of the casing 128 and an end face in close contact with the inner face of the end wall portion 134 of the casing 128. The conductors 130 and 132 axially projecting from the inner end face of the insulating plug 138 have their respective inner axial ends in contact with the inner end face of the high-melting-point fusible element 152 as shown or located in proximity to the inner end face of the fusible element 152. The conductors 130 and 132 have inner axial end portions closely received in tubular terminal or low-melting-point fusible elements 154 and 156, respectively, of an electrically conductive, thermally fusible alloy having a predetermined melting point lower than the above-mentioned melting point of the material forming the high-melting-point fusible element 152. An electrically conductive rigid connector plate or element 158 formed with two through holes 160 and 162 having diameters substantially equal to the outside diameters of the tubular low-melting-point fusible elements 154 and 156 and substantially aligned with the axial bores 148 and 150, respectively, in the insulating plug 138 is positioned on the inner end face of the high-melting-point fusible element 152 and has an outer peripheral surface inwardly spaced apart from the inner peripheral surface of the casing 128 so as to form a circular or generally oval gap between the outer peripheral surface of the connector element 158 and the inner peripheral surface of the casing 128. The low-melting-point fusible elements 154 and 156 mounted on the respective inner axial end portions of the conductors 130 and 132 are closely passed through the holes 160 and 162 in the connector element 158. When the pellet constructing the high-melting-point fusible element 152 remains rigid as shown in FIG. 15, the connector element 158 is mechanically connected to the inner axial end portions of the conductors 130 and 132 through the low-melting-point fusible elements 154 and 156 so that electrical connection is established between the conductors 130 and 132 through the low-melting-point fusible elements 154 and 156 and high-melting-point fusible element 152.

A spring-seat member 164 of a rigid, electrically non-conductive material has an axial wall portion and a cross wall portion formed with two through holes 166 and 168 which are slightly larger in diameter than the conductors 130 and 132 and which are substantially aligned with the axial bores 148 and 150 respectively, in the insulating plug 138, and accordingly with the through holes 160 and 162, respectively, in the connector element 158. The spring-seat member 164 is positioned within the casing 128 in such a manner that the axial wall portion thereof fits in the previously mentioned circular or oval gap between the outer peripheral surface of the connector element 158 and the inner peripheral surface of the casing 128 and the cross wall portion of the spring-seat member 164 has one end face in contact with the end face of the connector element 158 opposite to the high-melting-point fusible element 152. The axial wall portion of the spring-seat member 164 projects from the cross wall portion of the member 164 toward the inner end face of the high-melting-point fusible element 152 over a length which is substantially equal to the thickness of the connector element 158 so that the axial end portion bears at its leading end against the inner end face of the high-melting-point fusible element 152 as shown in FIG. 15. The through holes 166 and 168 in the cross wall portion of the spring-seat member 164 are located adjacent to the through holes 160 and 162, respectively, in the connector element 158 which is received in the spring-seat member 164 so that the conductors 130 and 132 anchored at their leading end portions to the connector element 158 by means of the low-melting-point fusible elements 154 and 156 are axially passed through the holes 166 and 168, respectively, in the spring-seat member 164. A preloaded helical compression spring 170 is positioned within the casing 128 in surrounding relationship to axial portions of the conductors 130 and 132 projecting from the inner end face of the insulating plug 138 and is seated at one end on the end face of the spring-seat member 164 opposite to the axial wall portion of the member 164 and at the other end on the chamfered edge at the inner axial end of the insulating plug 138, thereby urging the spring seat member 164 toward the high-melting-point fusible element 152 so that the axial wall portion of the spring-seat member 164 is forced at its leading end against the inner end face of the fusible element 152. The outer axial wall portion of the insulating plug 138 protruding from the casing 128 is encapsulated in a sealing and insulating cap 172 covering the inwardly bent edge 136 of the casing 128 as shown.

Figure 16:
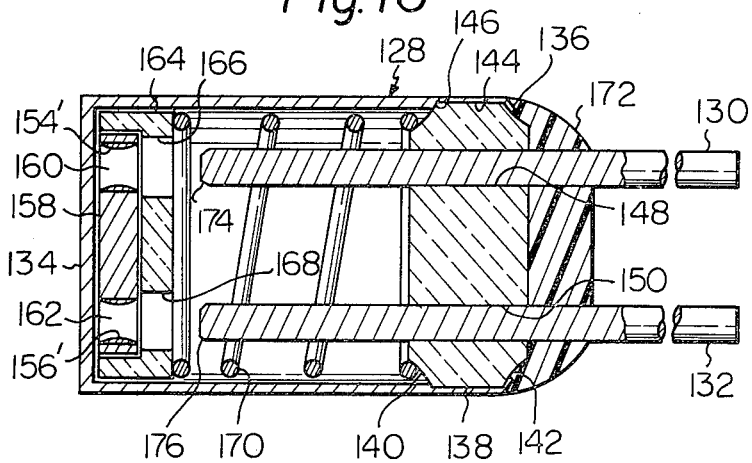
FIG. 16 is a view similar to FIG. 15 but shows the current interrupter in a condition interrupting the flow of the current therethrough.

When, now, the temperature of the heat surrounding the casing 128 reaches a certain level and as a consequence the temperature of the fusible elements 154 and 156 reaches the predetermined melting point of the elements, the fusible elements 154 and 156 are caused to melt and allow the connector element 158 to become axially movable relative to the conductors 130 and 132 which are fixedly held in position with respect to the casing 128. As the high-melting-point fusible element 152 is further heated and the temperature thereof reaches the predetermined melting point of the particular fusible element, the fusible element 152 is also caused to melt and becomes fluidic. The connector element 158 and the spring-seat member 164 are therefore permitted to axially move away from the inner end face of the insulating plug 138 by the force of the compression spring 170 urging the spring-seat member 164 toward the high-melting-point fusible element 152 which is now in a molten condition. The connector element 158 is thus mechanically disengaged from the conductors 130 and 132 with the molten material flowing past the connector element 158 mainly through the holes 160 and 162 in the element 158 and the holes 166 and 168 in the spring-seat member 164 being moved toward the end wall portion 134 of the casing 128, thereby interrupting the electrical connection between the conductors 130 and 132 which are now mechanically and electrically disconnected from the connector element 158. The connector element 158 and the spring-seat member 164 are finally brought into contact with the inner face of the end wall portion 134 of the casing 128 by the force of the compression spring 170 axially expanded from the compressed condition as illustrated in FIG. 16. Designated by 154' and 156' are molten materials resulting from the low-melting-point fusible elements 154 and 156, respectively. In order to prevent stringing of each of these molten materials 154' and 156' between each of the inner axial ends of the conductors 130 and 132 and the connector element 158 thus disconnected from the conductors, the conductors 130 and 132 preferably have the edges at their respective inner axial ends chamfered or rounded as at 174 and 176, respectively.

Figure 17:
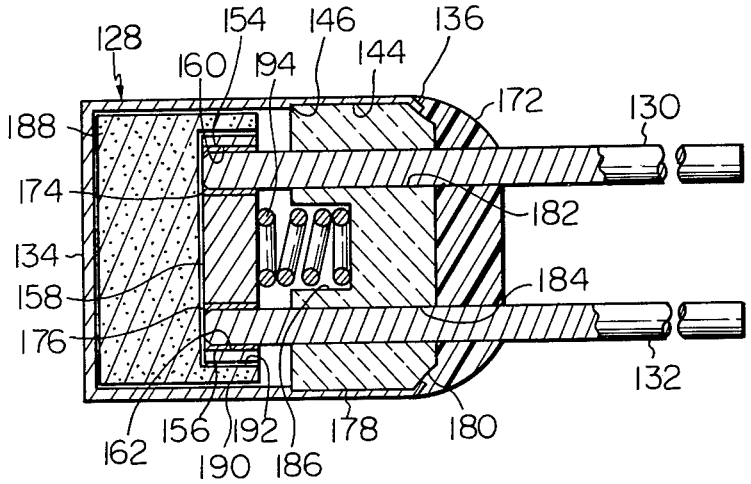
FIG. 17 is a longitudinal sectional view showing a sixth preferred embodiment of the current interrupter according to the present invention.

While the compression spring 170 provided in the above described embodiment is arranged to exert its force on the connector element 158 by means of the spring-seat member 164, the embodiment of FIG. 15 may be modified so that the spring is seated directly on the connector element 158 and accordingly the connector element 158 is axially moved directly by means of the spring upon collapse of the high-melting-point fusible element 152. FIG. 17 illustrates such a modification of the embodiment of FIG. 15.

The embodiment illustrated in FIG. 17 comprises a casing 128, conductors 130 and 132, low-melting-point fusible elements 154 and 156 and a connector plate or element 158 which are constructed and arranged similarly in themselves to their respective counterparts in the embodiment of FIG. 15. The casing 128 of the embodiment shown in FIG. 17 has closely mounted in its axial end wall portion adjacent to the inwardly bent edge 136 an insulating plug 178 which has an axially outer end wall portion protruding outwardly from the casing 128 and which has the edge at its outer axial end chamfered as at 180 and closely received on the inner face of the bent edge 136 of the casing 128, similarly to the insulating plug 138 of the embodiment of FIG. 15. The insulating plug 178 is formed with two axial bores 182 and 184 which are substantially parallel with the longitudinal wall portion of the casing 128 and which are open at both axial ends of the insulating plug 178. The conductors 130 and 132 are closely passed through these parallel bores 182 and 184, respectively, and extend into the casing 128. The casing 128 of the embodiment of FIG. 17 is also shown to have internally formed in its axial wall portion adjacent to the inwardly bent edge 136 a circumferential groove 144 forming an internal edge 146 through which the inner peripheral surface of the casing 128 is radially or laterally inwardly stepped into the circumferential groove 144. The insulating plug 178 is closely received in this circumferential groove 144 with its inner axial end in contact with the internal edge 146 of the casing 128 so that the insulating plug 178 is fixedly held in axial position within the casing 128. The insulating plug 178 is further formed with an axial concavity 186 which has a predetermined depth and which is open at the inner axial end of the insulating plug 178. The outwardly protruding axial end wall portion of the insulating plug 178 is encapsulated in a sealing and insulating cap 172 covering the inwardly bent edge 136 of the casing 128 as in the embodiment of FIG. 15.

Figure 18:
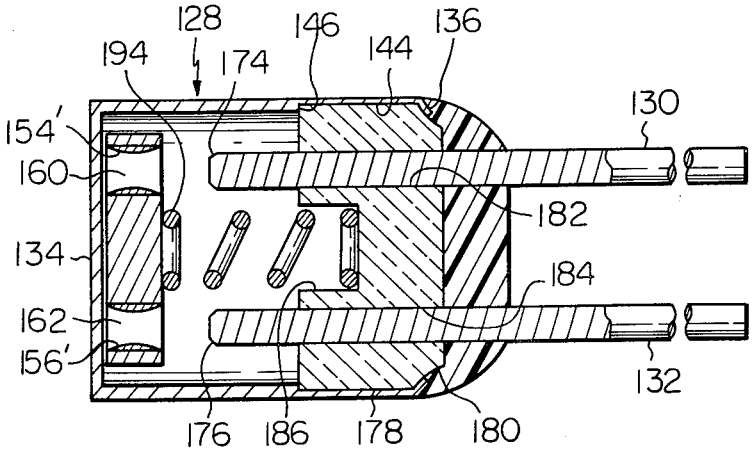
FIG. 18 is a view similar to FIG. 17 but shows the current interrupter in a condition interrupting the flow of the current therethrough.

The embodiment shown in FIG. 17 further comprises a temperature responsive or high-melting point fusible element 188 having an end face closely received on the inner face of the end wall portion 134 of the casing 128. The high-melting-point fusible element 188 is formed with an axial projection 190 extending toward the inner end face of the above described insulating plug 178 and interposed between the outer peripheral surface of the casing 128 as shown. The axial projection 190 of the high-melting-point fusible element 188 thus forms in an inner axial end wall portion of the fusible element a shallow concavity or recess 192 which is circumscribed by the inner peripheral surface of the axial projection 190. The connector element 158 mounted on the inner axial end projections of the conductors 130 and 132 through the low-melting-point fusible elements 154 and 156 is received in its entirety as shown or at least in part in this concavity or recess 192 in the high-melting-point fusible element 188. The connector element 158 is forced against the bottom face of the concavity or recess 192 by means of a preloaded helical compression spring 194 which is seated at one end on the bottom face of the axial concavity 186 in the insulating plug 178 and at the other end on the connector element 158 having an end face toward which the axial concavity 186 is open. The connector element 158 is thus urged by the force of the compression spring 194 to axially move away from the inner end face of the insulating plug 178. When the high-melting-point fusible element 188 is maintained in a rigid state, the connector element 158 is held in position within the concavity or recess 192 in the fusible element 188 against the force of the compression spring 194. When, however, the high-melting-point fusible element 188 is melted by the heat generated by an over-current flowing between the conductors 130 and 132 through the low-melting-point fusible elements 154 and 156 and the connector element 158, the compression spring 194 thus arranged forces the connector element 158 to axially move toward the inner face of the end wall portion 134 of the casing 128 and breaks the electrical connection between the conductors 130 and 132 as shown in FIG. 18, as will be readily understood from the description regarding the arrangement of FIGS. 15 and 16.

The casing 128 in each of the above described embodiments of FIGS. 15 and 17 has been assumed to be formed of an electrically conductive material but, if desired, may be constructed of an electrically non-conductive rigid material which is highly heat conductive. While, furthermore, the casing in each of the embodiments of FIGS. 3, 7, 9 and 11 has been described to have a generally cylindrical configuration, the same may have any other configuration such as a flattened configuration having an oval or generally rectangular cross section.

From the foregoing description it will be appreciated that the temperature responsive current interrupter according to the present invention has the following advantages.

1. Because of the fact that both an electrically non-conductive fusible element and electrically conductive fusible elements are used in combination, the threshold temperature at which the interrupter is to be initiated into motion to interrupt the current therethrough can be controlled accurately and the connector element is substantially free from sliding friction when moved within the casing, minimizing the irregularity in the performance characteristics of individual interrupters to be manufactured on a large-scale commercial basis.

2. Only one spring being used to move the connector element away from the conductor or conductors, not only the overall construction can be simplified and accordingly the production cost of the protective device can be significantly reduced as compared with the prior art device shown in the previously cited U.S. Pat. No. 3,519,972 but the irregularity in the movement of the connector element to be moved by means of two springs can be avoided.

3. The electrically non-conductive fusible element being free from the oxidizing effect of the current to flow through the conductive elements of the current interrupter and having a melting point which is higher than the melting points of the electrically conductive fusible elements, the temperature at which the interrupter is to be initiated into motion to interrupt the current therethrough is dictated solely by the melting point of the non-conductive fusible element. The initially designed responsiveness of the current interrupter to temperature is, for this reason, practically not subject to change throughout the period of time for which the interrupter is to be in use.

4. In a prior-art temperature responsive current interrupter in which electrical connection between the individual conductive elements is provided by mechanical contact between the elements, it is inevitable that heat is generated by the contact resistances between the conductive elements, causing a rise of temperture of the order of 10° in centigrade when a current of 10 amperes is passed through a conductor having the diameter of 1 millimeter. Such an increment of temperature due to the heat generated between the conductive elements can be reduced to approximately 7° as compared with the temperature use invited in the current interrupter according to the present invention in which the conductors are mechanically and accordingly electrically connected together by means of fusible elements of a low-melting-point alloy.

5. While the conductive elements in such a prior-art current interrupter must be plated with gold or silver so as to enhance the electrical conductivity of each of the conductive elements, such extra and expensive processing is not necessitated in the current interrupter according to the present invention in which the conductors are mechanically and electrically connected by means of the tubular fusible elements which are assuredly held in surface-to-surface contact with the conductors and the connector element.

What is claimed is:

1. A temperature responsive current interrupter, comprising a thermally conductive, hollow casing, two elongated conductors which extend into the casing through insulating means secured to the casing and which have respective inner axial end portions which are spaced apart from each other within the casing, two electrically conductive, normally rigid, thermally fusible elements each having a predetermined melting point and mounted on each of said inner axial end portions of said conductors, an electrically conductive connector element interconnecting the conductive fusible elements, an electrically non-conductive, normally rigid, thermally fusible element which has a predetermined melting point higher than said melting point of each of said conductive fusible elements and which is in surface-to-surface contact with said connector element, the connector element being movable toward a position separate from at least one of said conductors in the absence of the non-conductive fusible element in a rigid state, and resilient biasing means urging said conductor element against said non-conductive fusible element and toward said position thereof.

2. A temperature responsive current interrupter as set forth in claim 1, in which the respective inner axial end portions of said conductors extend substantially in line with each other and are axially spaced apart a predetermined distance from each other within said casing.

3. A temperature responsive current interrupter as set forth in claim 2, in which said casing has opposite end portions longitudinally spaced apart from each other and in which said insulating means comprises two insulating plugs each of which is securely positioned at least in part in each of said end portions of the casing, said conductors axially extending into the casing respectively through said insulating plugs.

4. A temperature responsive current interrupter as set forth in claim 3, in which said conductors consist of first and second conductors and said insulating plugs consist of said first and second insulating plugs having respective inner end faces which are spaced apart a predetermined distance from each other within said casing, said non-conductive fusible element having opposite end faces one of which is in contact with the inner end face of the first insulating plug, the first conductor axially extending into the casing through the first insulating plug and said non-conductive fusible element and having the inner axial end portion thereof axially projecting from the other end face of the non-conductive fusible element, the second conductor axially extending into the casing through the second insulating plug and having the inner axial end portion thereof axially projecting from the inner end face of the second insulating plug.

5. A temperature responsive current interrupter as set forth in claim 4, in which each of said conductive fusible elements has a tubular configuration and is closely received on each of the inner axial end portions of said conductors, said connector element having a tubular portion and a flange portion radially outwardly projecting from one axial end of the tubular portion and having an outer end face held in contact with said other end face of said non-conductive fusible element, said tubular portion of the connector element having axial end portions respectively having said conductive fusible elements closely received therein.

6. A temperature responsive current interrupter as set forth in claim 5, in which said biasing means comprises a preloaded helical compression spring which is positioned within said casing in radially surrounding relationship to the tubular portion of said connector element and which is seated at one end on the inner end face of said flange portion of the connector element and at other end on the inner end face of said second insulating element.

7. A temperature responsive current interrupter as set forth in claim 3, in which said casing has a longitudinal end wall portion which is internally formed with a circumferential groove forming an internal edge through which the inner peripheral surface of the remaining longitudinal wall portion of the casing is laterally inwardly stepped into said groove, one of said insulating plugs being securely received at least in part in said circumferential groove.

8. A temperature responsive current interrupter as set forth in claim 4, in which said second conductor is formed with a radial projection in close contact with the inner end face of said second insulating plug.

9. A temperature responsive current interrupter as set forth in claim 3, in which each of said insulating plugs has an outer end portion longitudinally protruding outwardly from each of said opposite end portions of said casing and in which said insulating means further comprises two sealing and insulating members respectively encapsulating said insulating plugs therein.

10. A temperature responsive current interrupter as set forth in claim 5, in which said biasing means comprises an electrically non-conductive spring-seat member having opposite end faces one of which is in contact with the inner face of said flange portion of said connector element and the other of which is spaced apart a predetermined distance from the inner face of said second insulating plug in a direction substantially parallel with said tubular portion of the connector element, the spring-seat member being formed with an axial bore which is open at the opposite ends of the member and which has a diameter slightly larger than the outside diameter of said tubular portion of said connector element, said tubular portion being axially passed through said axial bore in the spring-seat member, and a preloaded helical compression spring which is positioned within said casing in radially surrounding relationship to part of said tubular portion of said connector element and which is seated at one end on the inner end face of said second insulating plug and at the other end on the end face of said spring-seat member opposite to said non-conductive fusible element.

11. A temperature responsive current interrupter as set forth in claim 5, in which said second conductor has a chamfered edge at its inner axial end.

12. A temperature responsive current interrupter as set forth in claim 5, in which each of said first and second conductors has a chamfered edge at its inner axial end.

13. A temperature responsive current interrupter as set forth in claim 5, further comprising an insulating member which is fixedly interposed between the respective inner axial ends of said first and second conductors.

14. A temperature responsive current interrupter as set forth in claim 5, in which said second insulating plug is formed with an axial concavity which is open at the inner end of the plug and which has a cross sectional area slightly larger than the tubular portion of said connector element, the inner axial end portion of said second conductor axially projecting into said concavity from the vottom end of the concavity and said tubular portion of said connector element axially projecting into the concavity through the open end of the concavity.

15. A temperature responsive current interrupter as set forth in claim 14, in which said biasing means comprises a preloaded helical compression spring which is positioned within said casing in radially surrounding relationship to part of the tubular portion of said connector element and which is seated at one end on the inner end face of said flange portion of the connector element and at the other end on the inner end face of said second insulating plug.

16. A temperature responsive current interrupter as set forth in claim 15, in which said second insulating plug has an inner end wall portion formed with an annular recess having an inner peripheral end circumscribing the open end of said axial concavity in said second insulating plug, said compression spring being seated at said other end in said recess.

17. A temperature responsive current interrupter as set forth in claim 14, in which said second conductor is formed with a radial projection closely received on the bottom end of said axial concavity in said second insulating plug.

18. A temperature responsive current interrupter as set forth in claim 14, in which said casing is constructed of an electrically non-conductive rigid material.

19. A temperature responsive current interrupter comprising, in combination, a thermally conductive, hollow, elongated casing having opposite longitudinal end portions, first and second insulating plugs each securely positioned at least in part in each of said end portions of said casing, the insulating plugs having respective inner end faces which are spaced apart a predetermined distance from each other within said casing, an electrically non-conductive, normally rigid, thermally fusible element having a predetermined melting point and having opposite end faces one of which is in contact with the inner end face of the first insulating plug and the other of which is spaced apart a predetermined distance from the inner end face of the second insulating plug, a first elongated conductor axially extending through said first insulating plug and the non-conductive fusible element into said casing and having an inner axial end portion axially projecting from said other end face of the non-conductive fusible element, a second elongated conductor axially extending through said second insulating plug and having an inner axial end portion axially projecting from the inner end face of said second insulating plug, the respective inner axial end portions of the first and second conductors extending substantially in line with each other and axially spaced apart a predetermined distance from each other within said casing, two tubular electrically conductive, normally rigid, thermally fusible elements each having a predetermined melting point which is lower than said melting point of said non-conductive fusible element and closely received on the inner axial end portion of each of the first and second conductors, an electrically conductive connector element having a tubular portion and a flange portion radially outwardly projecting from one axial end of the tubular portion and having an outer end face held in contact with said other end face of said non-conductive fusible element, said tubular portion of the connector element having axial end portions respectively having said conductive fusible elements closely received therein for providing electrical connection between said first and second conductors through the conductive fusible elements and said connector element, the connector element being movable away from the inner end face of said second insulating plug toward a position separate from the inner axial end portion of the second conductor in the absence of the non-conductive fusible element in a rigid state, and resilient biasing means urging the flange portion of said connector element against said other end face of said non-conductive fusible element and thereby biasing said connector element to move toward said position thereof.

20. A temperature responsive current interrupter comprising, in combination, a thermally conductive hollow casing having an end wall portion closing one end of the casing, an insulating plug closely received at least in part in a longitudinal end portion of said casing adjacent to the other end of the casing, an electrically non-conductive, normally rigid, thermally fusible element having a predetermined melting point and opposite end faces one of which is in close contact with the inner face of said end wall portion of the casing, an electrically conductive connector element having opposite end faces one of which is in contact with the other end face of said non-conductive fusible element and the other of which is spaced apart a predetermined distance from the inner end of said insulating plug, the connector element being formed with two through holes having respective center axes substantially normal to the other end face of the non-conductive fusible element, two tubular, electrically conductive, normally rigid, thermally fusible elements each of which has a predetermined melting point lower than said melting point of said non-conductive fusible element and which is closely inserted in each of said through holes in said connector element, two elongated conductors extending through said insulating plug into said casing and having respective inner axial end portions axially projecting substantially in parallel with each other from the inner end of the insulating plug in directions substantially normal to the end faces of said connector element, the respective inner axial end portions of the conductors being closely received in said conductive fusible elements, respectively, for being electrically connected together through said conductive fusible elements and said connector element, the connector element being movable away from the inner end of said insulating plug toward a position close to the inner face of said end wall portion of said casing and separate from the respective inner axial end portions of said conductors in the absence of said non-conductive fusible element in a rigid state, and resilient biasing means urging said connector element against the end face of the non-conductive fusible element to the end wall portion of said casing and thereby biasing the connector element to move toward said position thereof.

21. A temperature responsive current interrupter as set forth in claim 20, in which said insulating plug has an inner end face within said casing and said connector element has an outer peripheral surface laterally inwardly spaced apart from the inner peripheral surface of said casing and in which said resilient biasing means comprises a spring-seat member having an axial wall portion interposed between said outer peripheral surface of said connector element and said inner peripheral surface of the casing and a cross wall portion having opposite end faces one of which is adjacent to the end face of said connector element opposite to said non-conductive fusible element and the other of which is spaced apart a predetermined distance from said inner end face of the insulating plug, said cross wall portion of the spring-seat member being formed with two through holes which are substantially aligned respectively with said through holes in said connector element and each of which is slightly larger in diameter than each of said conductors, the inner axial end portions of said conductors being passed through said holes in the spring-seat member toward said connector element, and a preloaded helical compression spring which is positioned within said casing in laterally surrounding relationship to the respective inner axial end portions of said conductors and which is seated at one end on the end face of the cross wall portion of said spring-seat member opposite to said connector element and at the other end on the inner end face of said insulating element.

22. A temperature responsive current interrupter as set forth in claim 20, in which said insulating plug is formed with an axial concavity open at the inner end of the plug and having a bottom end opposite to said connector element and in which said resilient biasing means comprises a preloaded helical compression spring which is positioned between the respective inner axial end portions of said conductors and which partly extends in said axial concavity, said compression spring being seated at one end on the end face of said connector element opposite to said non-conductive fusible element and at the other end on said bottom end of said concavity in said insulating plug.

23. A temperature responsive current interrupter as set forth in claim 22, in which said connector element has an outer peripheral surface laterally inwardly spaced apart from the inner peripheral surface of said casing and in which said non-conductive fusible element has an axial projection interposed between said outer peripheral surface of said connector element and the inner peripheral surface of said casing.

24. A temperature responsive current interrupter as set forth in claim 20, in which said casing has a longitudinal end wall portion adjacent to said other end of the casing and has said longitudinal end wall portion internally formed with a circumferential groove forming an internal edge which is longitudinally spaced apart a predetermined distance from said other end of the casing and through which the inner peripheral surface of the remaining longitudinal wall portion of the casing is laterally outwardly stepped into said circumferential groove, said insulating plug being received at least in part in said circumferential groove.

25. A temperature responsive current interrupter as set forth in claim 20, in which said insulating plug has an outer end wall portion protruding outwardly from said other end of said casing, the interrupter further comprising a sealing and insulating member encapsulating said outer end wall portion of the insulating plug therein.

26. A temperature responsive current interrupter as set forth in claim 20, in which each of said conductors has a chamfered edge at its inner axial end.

27. A temperature responsive current interrupter as set forth in claim 1, in which said non-conductive fusible element is constructed of an inorganic compound selected from the group consisting of acetanilide, succinimide, cyclohexanehexole, benzo-$\alpha$-pyrene, and 4-hydroxy-3-methoxy-benzaldehyde.

28. A temperature responsive current interrupter as set forth in claim 1, in which said casing is formed of an electrically conductive rigid material.

29. A temperature responsive current interrupter as set forth in claim 1, in which said casing is formed of an electrically non-conductive rigid material.

* * * * *